United States Patent [19]

Weinar

[11] 4,123,887

[45] Nov. 7, 1978

[54] STRENGTHENING OF CHANNEL SHAPED BUILDING COLUMNS AND BEAMS

[76] Inventor: Roger N. Weinar, 168 W. Woodside Ave., Buffalo, N.Y. 14220

[21] Appl. No.: 813,335

[22] Filed: Jul. 6, 1977

[51] Int. Cl.[2] ..... E04C 3/32

[52] U.S. Cl. ..... 52/720

[58] Field of Search ..... 52/720, 731, 730, 729, 52/695, 613, 243, 629, 617, 579, 712, 657, 654, 634, 647, 580, 684–687; 108/513, 51 R; 211/261 R; 24/184

[56] References Cited

U.S. PATENT DOCUMENTS

| | | | |
|---|---|---|---|
| 867,379 | 10/1907 | Kaufmann | 24/261 R |
| 1,454,254 | 5/1923 | Roney | 24/261 R |
| 1,753,094 | 4/1930 | Sacerdote | 24/261 R |
| 2,096,263 | 10/1937 | Ruhlman | 24/261 R |
| 3,132,448 | 5/1964 | Phillips | 52/689 |
| 3,461,638 | 8/1969 | Balinski | 52/732 |
| 3,557,512 | 1/1971 | Braeuninger | 108/51.1 |
| 3,624,694 | 11/1971 | Byland | 52/241 |

FOREIGN PATENT DOCUMENTS

| | | | |
|---|---|---|---|
| 937,111 | 6/1963 | United Kingdom | 211/184 |

*Primary Examiner*—John E. Murtagh
*Attorney, Agent, or Firm*—Raymond F. Kramer

[57] ABSTRACT

Building columns of generally squared C shape are strengthened by rigidification with a novel bridge member so that inward deflections of the flanges of the C are prevented by insertion of the bridge. The bridge includes a transverse intermediate portion which fits between the ends of the channel flanges to prevent inward deflections thereof, a pair of inclined crossing leg portions and a pair of opposing foot portions, each joined to a leg portion and adapted to fit in the interiors of opposed corners of the channel between the flanges thereof and the connecting part.

10 Claims, 5 Drawing Figures

STRENGTHENING OF CHANNEL SHAPED BUILDING COLUMNS AND BEAMS

BACKGROUND OF THE INVENTION:

Channel shaped framing members of a generally squared C shape in cross-section are in common use in the construction industry. Among the most common types of such framing members or columns are those which are roll formed from comparatively light guage sheet metal, such as steel or aluminum, although synthetic polymeric plastic materials may also be employed, as in fiber reinforced products. These are often used as studs in the construction of fire retardant walls and partitions. Although the use of such studs has been very successful one defect in them has been the tendency of the flanges or the top and bottom of the C to distort when transverse loads are applied to them. Particularly, when the building columns are used for door and window framing, wherein they may be subjected to more severe loading conditions than when used for ordinary wall studding, or when fasteners, such as drive screws, are to be applied to the flanges it has often been found necessary to rigidize the channel shaped framing members. A common practice on the job site is to restrict the inward deflection of the channel flanges by insertion of wood blocks or fillers in the channel cavity. Such fillers have to be nailed or screwed into place at suitable intervals along the channel. Because the channels are often intentionally slightly asymmetric in cross-section to permit a telescopic connection to form a column of essentially rectangular cross-section, for best fit of the filler to the channel and best rigidification the wood fillers must be cut to a special shape, not merely rectangular in cross-section, which is difficult and costly.

SUMMARY OF THE INVENTION

In accordance with the present invention a rigidized hollow channel structural member of generally or substantially squared C or U shape in cross-section comprises an elongated or longitudinally extending channel structural member of the described shape, reinforced and rigidized so that the flanges of the channel resist deflections inwardly, by insertion therein of a rigidizing bridge having a transverse intermediate portion, a pair of inclined crossing leg portions, each joined to the intermediate portion, and a pair of opposing foot portions, each joined to a leg portion and adapted to fit in the interiors of opposed corners of the channel between the flanges thereof and the connecting part, and rigidizing bridge being located so that the transverse intermediate portion thereof is between the channel flange ends and at right angles to the flanges and the feet thereof are in the interiors of opposed corners of the channel and parallel thereto and hold the transverse intermediate portion of the bridge in position at right angles to the channel flanges.

The invention also relates to the described rigidizing bridges and to a method for their installation in the channel shaped building columns.

The invention thereby provides a simple and inexpensive article and method for strengthening channel shaped building columns (and beams) which requires no tools at all. Furthermore, the rigidizing members are removable at will and can be re-used. Additionally, they are small in volume and light in weight so that the installer can easily carry on his person a good supply for strengthening several channel shaped columns.

Figure 1:
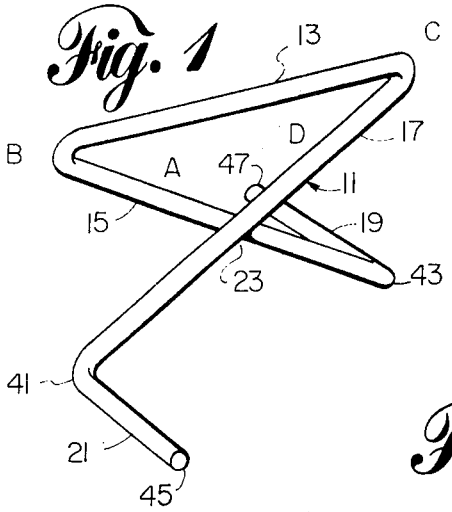
FIG. 1 is a perspective view of a wire bridge of this invention.

DETAILED DESCRIPTION OF THE INVENTION AND A PREFERRED EMBODIMENT:

In FIG. 1 the wire bridge 11 of the present invention is shown. It includes intermediate portion 13, a pair of inclined crossing leg portions or legs 15 and 17, with that designated 15 being the upper one (when installed, as in FIG. 2) and foot portions or feet 19 and 21. The legs, while they may be of different lengths, are preferably of the same length and cross at about their midpoints, at location 23. The feet 19 and 21 are joined to respective legs 15 and 17 and are opposing, extending in opposite although parallel directions at about right angles to the legs. Angles ABC and BCD are normally the same, although they can be slightly different, and usually will be within the range of 20° to 60°, preferably being from 25° to 45°, e.g., about 35°. Feet 19 and 21 are also preferably of the same length but may be different, if desired for particular applications.

Figure 2:
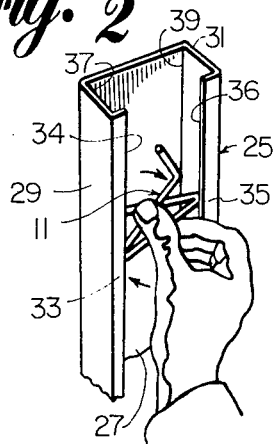
FIG. 2 is a fragmentary assembly view showing normal installation of a wire bridge of this invention (the same as that of FIG. 1) in a typical C-shaped channel column member.

In FIG. 2 is shown the hand installation of bridge 11 in C-shaped channel building column 25. As illustrated, the column is employed as a building or framing stud and is in vertical position. It comprises a longitudinal web or connecting part 27, connecting flanges 29 and 31 which are at right angles to the web, and inwardly turned flange portions 33 and 35 at the flange ends. As is indicated by the arrows, hand turning of the bridge in a clockwise direction moves it into rigidifying or rigidizing position with intermediate stabilizing portion 13 (see FIG. 1) preventing flanges 29 and 31 from being deflected inwardly upon application of external forces on the flanges. In such position feet 19 and 21 are aligned with and press against flanges 29 and 31 along corners (internal) 37 and 39 respectively. Installation of the bridge is readily effected by inserting it inside the hollow channel with the ends of the intermediate portion between the inner ends 34 and 36 of the inwardly turned flange portions 33 and 35, pressing the bridge in the direction of the channel web until that portion is "under" portions 33 and 35, turning the bridge clockwise (in this case) so that the "heels" 41 and 43 move forward ahead of the "toes" 45 and 47, until the intermediate portion of the bridge is in rigidizing position at right angles to the axis of the longitudinal column, and then releasing the pressure on the rigidizing member so that it "springs" into place, with the feet in the corners 37 and 39 and pressed against web 27 and flanges 29 and 31 and with the intermediate portion pressed against flange portions 33 and 35. Of course, the dimensions of the bridge member will be chosen so as to facilitate such ready installation. Removal and/or adjustments may be effected by reversing the procedure, pressing the bridge against the channel connecting part 27 and rotating counterclockwise and withdrawing.

Figure 3:
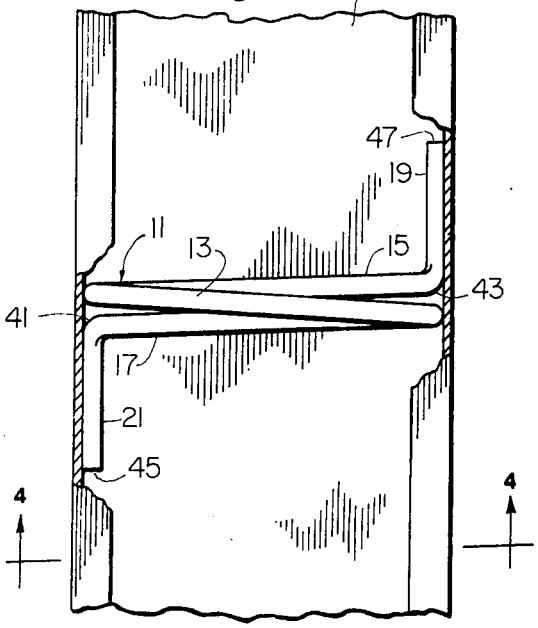
FIG. 3 is a fragmentary front elevation of a typical channel member with parts of the inwardly directed flange ends or return portions cut away to show the bridge in installed position.
Figure 4:
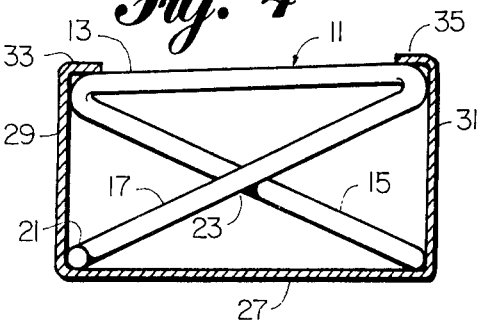
FIG. 4 is a sectional view along plane 4—4 of FIG. 3, illustrating the positioning of the bridge in an asymmetrically flanged channel (flanges of different widths)
Figure 5:
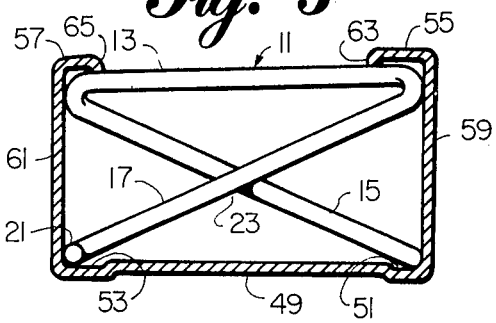
FIG. 5 is a sectional view corresponding to that of FIG. 4 but of a preferred installation of the bridge in a channel of preferred structure.

FIGS. 3 and 4 show in greater detail than FIG. 2 the position of the rigidizing bridge when in rigidizing position. The same numerals are employed as in FIGS. 1 and 2. It will be noted that flange 31 is wider than flange 29, which facilitates the known telescoping of the C-shaped columns together so as to make a stronger column of substantially rectangular cross-section. In FIG. 5 is illustrated an installation of the strengthening bridge of this invention in a preferred channel of known design wherein channel web 49 has grooves 51 and 53 into which feet 19 and 21 fit, when installed and inwardly turned flange ends 55 and 57 on flanges 59 and 61 have "downwardly" (for want of a better word) extending portions 63 and 65 so that these contact the "top" part of intermediate bridge portion 13, using FIG. 5 as a reference for the relative directions and locations mentioned. Such contacts tend to hold the bridge in position better than in the embodiments illustrated in the other figures. It will be appreciated that the grooves 51 and 53 and the inwardly extending flange ends 55 and 57, as well as the flanges 59 and 61, are of such lengths so that a pair of the channels can be telescoped together to form a well held rectangular column.

The materials of construction of the channel may be any suitable ones, with sheet steel, usually cold rolled, generally being preferred, but aluminum, magnesium, steel alloys synthetic organic polymeric plastics, etc., may also be used. Of the plastics it is preferred to employ fiber reinforced polymers such as polyesters and polyethers, ABS, polystyrenes and others of equivalent strengths and properties. Normally the thickness of the rolled steel or other metal sheet will be in the range of 0.4 to 3 mm., preferably 0.5 to 2 mm. and most preferably about 0.9 mm. but for other materials greater thicknesses (and conceivably, lesser thicknesses, too) can be used.

The rigidizing member will be of sufficient springiness to fit in position by hand pressure and press against the channel web or grooves and flange ends (inwardly or downwardly directed) and be held in place by the "spring tension". Generally the force exerted will be less than a kilogram, often less than 500 g. and sometimes less than 200 g. but usually it should be greater than 25 g. and is preferably greater than 50 g. Ordinary cold drawn steel of a composition like that of cold rolled or comparatively soft steel may be used but stiffer and springier steels and other metals or materials are more useful, such as are described as silicon steels or manganese steels, which are well known for use in coil spring manufacture. The rigidizing member may be of various cross-sectional shapes but circular is preferred and it is highly preferred to bend wire to shape. Normally the circular wire will have a diameter in the range of 1 to 5 mm., preferably 1.5 to 3 mm. and more preferably about 2.5 mm., with cross-sectional areas in the ranges of 0.8 to 20 sq. mm., 1.5 to 7 sq. mm., and more preferably about 5 sq. mm., respectively. Other shapes may be elliptical, rectangular, square and arc.

The channel members have been described herein as of C shape but they may be considered also as of U shape or as rounded rectangular with an open side. By C shape it is meant that the channel has three sides and may have the flange sides turned in (preferably) and downwardly (more preferably), too. The channels are available commercially and sometimes may be of modified forms, e.g., with serrations or multiple strengthening grooves or corrugations, perforated, ridged, knurled, etc., which surface alterations can help to hold the present bridges in place better. In a similar manner the bridges or the wire thereof may be transversely or longitudinally serrated or grooved or ridged to improve holding in place on the channel. In some such embodiments the frictional fits obtained may obviate the need for the inwardly turned flange ends to hold the bridge in position.

The present invention, in its various aspects, is decidedly advantageous over the prior art methods and apparatuses for strengthening hollow building columns, whether studding, framing or beams or other members. The channels are readily available and known in the art. The rigidizing members are simple, readily made and installed and possess functional advantages over the wood blocks of the prior art and such structures as are illustrated in U.S. Pat. No. 3,989,396 (diaphragm reinforcements). They are easily stocked, carried and installed and can be readily removed (while the column is still accessible) or changed in position, as often becomes desirable in construction. A plurality of the reinforcements can be installed in advance or as the need arises during construction. They remain in place unless intentionally removed. If completely positive affixation is desired the feet may have toes created thereon (by bending) extending at right angles to the feet through perforations that may be provided in the channel web or grooves but such is not necessary because the residual springiness of the bridge material, preferably ASI 1010 or "coat hanger steel" or other suitable hard steel of increased carbon content, like ¾ hard steel or similar such available materials, will be sufficient to maintain enough tension on the channel interior surfaces to hold the bridge in place for long periods of time, e.g., 20 years and more.

Clearly, the invention is superior to the use of wooden blocks, which have to be nailed or screwed into place, and to diaphragms which have to be welded onto the channel stud. It is also superior to other "comparable" devices, such as bridges of similar design but without feet, and made of flat stock of sufficient width to serve to prevent rocking of the installed unit, much as the present feet do. It is cheaper to make, easier to bend and easier to install than such flat stock units. This is a significant advantage especially when a plurality of reinforcements is used per single channel building column.

All the described advantages are obtained merely from the use of an easily affixed "internal spring" having a sufficiently strong portion between the channel flanges to hold them against inward deflection. Such "spring" is of a relaxed height more than the channel height and of a width at the feet less than the channel inner width so that when placed in position the height is compressed and the bridge intermediate portion, of the right width to fit the channel, is pressed upwardly and against the inwardly turned flange ends of the channel. Such feature is near the heart of the present invention and the invention covers and includes all structures that are equivalent thereto or utilize substitutes for elements thereof and accomplish the results taught herein. Also, it should be considered as being applicable to similar channel structures to be strengthened.

I claim:

1. A rigidized hollow, elongated sheet metal channel structural member of generally squared C shape in cross-section which comprises an elongated sheet metal channel structural member of generally squared C shape in cross-section, reinforced and rigidized so that the flanges of the channel resist deflections inwardly, by insertion therein of a rigidizing bridge having a transverse intermediate portion, a pair of inclined crossing leg portions, each joined to the intermediate portion, and a pair of opposing foot portions, each joined to a leg portion and adapted to fit in the interiors of opposed corners of the channel between the flanges thereof and the connecting part, said rigidizing bridge being located so that the transverse intermediate portion thereof is between the channel flange ends and at right angles to them and the feet thereof are in the interiors of opposed corners of the channel and parallel thereto and hold the transverse intermediate portion of the bridge in position at right angles to channel flanges.

2. A rigidized hollow, elongated sheet metal channel structural member according to claim 1 wherein the flanges of the channel are turned in at the ends thereof and the transverse intermediate portion of the bridge bears against said inturned ends, thereby preventing loss of contact of such portion with the flanges.

3. A structural member according to claim 1 wherein the bridge is of a single piece of steel wire bent to form.

4. A structural member according to claim 1 wherein the channel has grooves at the interior corners thereof into which the feet of the rigidizing bridge fit.

5. A structural member according to claim 2 wherein the bridge is of a single piece of wire and the channel has a groove at each interior corner thereof into which the feet of the bridge fit.

6. A structural member according to claim 5 wherein the channel flanges are of different lengths, the bridge transverse intermediate portion is of the same length as the channel interior width and the bridge legs are of the same length, with the wire of the bridge being sufficiently resilient and the bridge legs being of such length that the transverse intermediate portion of the bridge is pressed against the inturned channel flange ends, which are also downwardly turned.

7. A structural member according to claim 6 wherein the wire of the bridge is round in cross-section.

8. A structural member according to claim 7 wherein a plurality of bridge members is present in the channel to rigidify it at a plurality of locations along its length.

9. A method of rigidizing an elongated sheet metal channel structural member of generally squared C shape in cross-section which comprises installing in said channel of the structural member a rigidizing bridge having a transverse intermediate portion, a pair of inclined crossing leg portions, each joined to the intermediate portion, and a pair of opposing foot portions, each joined to a leg portion and extending in opposed and parallel directions at right angles to the intermediate and leg portions, which bridge is adapted to fit said channel member with the intermediate portion preventing inward deflection of the ends of the channel flanges and the legs and feet holding said intermediate portion in position, by placing said bridge in position in the channel with the feet thereof against the portion of the channel connecting the flanges thereof and with the legs, intermediate portion and feet of the bridge at angles to the axis of the channel, and turning the bridge in a direction so that the points of connection between the legs and the feet are moving forward toward the channel flanges before the unconnected ends of the feet and halting said movement when the intermediate portion of the bridge is at right angles to said flanges.

10. A method according to claim 9 wherein the rigidizing bridge installed is of a single piece of steel wire of circular cross-section, the legs are of equal length and the steel wire is resilient enough to adapt the bridge to fit asymmetrically flanged channels and rigid enough to prevent inward deflections of the channel flange ends when inwardly directed forces are applied thereto, installation is in an asymmetrically flanged channel with one wall of greater width than the other, the channel walls are inwardly and downwardly turned at the ends thereof and before turning of the bridge and intermediate portion thereof is pressed toward the connecting part of the channel so as to be within the channel and nearer to said connecting part than the inwardly and downwardly turned ends of the channels, and, after turning the bridge so that it is so located that the intermediate portion thereof is at right angles to said flanges, releasing the pressure toward the connecting part of the channel so that the intermediate portion presses against the channel ends.

* * * * *